US009052125B1

(12) United States Patent
Dostal

(10) Patent No.: US 9,052,125 B1
(45) Date of Patent: Jun. 9, 2015

(54) DUAL CIRCUIT HEAT PUMP

(76) Inventor: Dennis S. Dostal, Rice Lake, WI (US)

( * ) Notice: Subject to any disclaimer, the term of this patent is extended or adjusted under 35 U.S.C. 154(b) by 385 days.

(21) Appl. No.: 13/599,522

(22) Filed: Aug. 30, 2012

Related U.S. Application Data

(60) Provisional application No. 61/532,250, filed on Sep. 8, 2011.

(51) Int. Cl.
*F25B 7/00* (2006.01)

(52) U.S. Cl.
CPC ..... *F25B 7/00* (2013.01)

(58) Field of Classification Search
CPC ..... F25B 7/00; F25B 13/00; F25B 25/005; F25B 30/00; F25B 30/02; F25B 1/00; F25B 41/062; Y02B 30/12
USPC ..... 62/79, 115, 175, 238.6, 238.7, 324.1, 62/333, 335, 498
See application file for complete search history.

(56) References Cited

U.S. PATENT DOCUMENTS

| | | | | |
|---|---|---|---|---|
| 2,513,373 | A | 4/1950 | Sporn et al. | |
| 4,025,326 | A * | 5/1977 | Leonard, Jr. | 62/175 |
| 4,257,239 | A | 3/1981 | Partin et al. | |
| 4,336,692 | A | 6/1982 | Ecker et al. | |
| 4,380,156 | A | 4/1983 | Ecker | |
| 4,575,001 | A | 3/1986 | Oskarsson et al. | |
| 4,592,206 | A | 6/1986 | Yamazaki et al. | |
| 4,646,537 | A * | 3/1987 | Crawford | 62/238.6 |
| 4,646,538 | A | 3/1987 | Backshaw et al. | |
| 4,693,089 | A | 9/1987 | Bourne et al. | |
| 4,727,727 | A | 3/1988 | Reedy | |
| 4,796,437 | A | 1/1989 | James | |
| 5,351,502 | A | 10/1994 | Gilles et al. | |
| 5,388,419 | A | 2/1995 | Kaye | |
| 5,465,588 | A | 11/1995 | McCahill et al. | |
| 5,467,812 | A | 11/1995 | Dean et al. | |
| 5,564,282 | A | 10/1996 | Kaye | |
| 5,678,626 | A | 10/1997 | Gilles | |
| 6,467,289 | B2 | 10/2002 | Kuroki et al. | |
| 6,895,781 | B2 | 5/2005 | Dobmeier et al. | |
| 7,640,763 | B2 | 1/2010 | Nishimura et al. | |
| 7,716,943 | B2 | 5/2010 | Seefeldt | |
| 8,640,475 | B2 * | 2/2014 | Park et al. | 62/238.7 |
| 2005/0268625 | A1 * | 12/2005 | Sienel et al. | 62/129 |
| 2009/0049857 | A1 | 2/2009 | Murakami et al. | |
| 2010/0218513 | A1 * | 9/2010 | Vaisman et al. | 62/6 |
| 2010/0293982 | A1 | 11/2010 | Favier | |
| 2010/0326622 | A1 | 12/2010 | Maxwell | |
| 2011/0088421 | A1 | 4/2011 | Wakamoto et al. | |
| 2012/0036854 | A1 * | 2/2012 | Vaisman et al. | 60/671 |

* cited by examiner

*Primary Examiner* — Melvin Jones
(74) *Attorney, Agent, or Firm* — Leanne Taveggia Farrell; Westman, Champlin & Koehler, P.A.

(57) ABSTRACT

A heat pump includes a compressor for compressing refrigerant. The compressed refrigerant is divided into a first portion and a second portion. Simultaneously, the first portion of the refrigerant is used in a first vapor-compression circuit to heat or cool a space and the second portion of the refrigerant is used in a second vapor-compression circuit to heat a fluid. In a single external source heat exchanger, both the first portion of the refrigerant in the first vapor-compression circuit and the second portion of the refrigerant in the second vapor compression circuit exchanges heat with an external source fluid.

19 Claims, 5 Drawing Sheets

DUAL CIRCUIT HEAT PUMP

CROSS-REFERENCE TO RELATED APPLICATION

The present application is based on and claims the benefit of U.S. provisional patent application Ser. No. 61/532,250, filed Sep. 8, 2011, the content of which is hereby incorporated by reference in its entirety.

BACKGROUND

Heat pumps are mechanical machines that move heat energy from a first environment to a second environment and also in reverse. Heat pumps use a vapor-compression cycle and an intermediate fluid (i.e., refrigerant). The refrigerant absorbs heat as it vaporizes in an evaporator and releases heat when it is condenses in a condenser.

An important component of the heat pump is a reversing valve, which allows the flow direction of the refrigerant to be changed such that heat can be pumped between two environments in either direction. In particular, a heat pump can bring heat into an occupied space or can remove heat from it. In a cooling mode, the heat pump uses an evaporator to absorb heat from inside the occupied space and rejects the heat to the outside through the condenser. In a heating mode, the heat pump absorbs heat from the outside through the condenser and moves the heat to the occupied space through the evaporator.

The discussion above is merely provided for general background information and is not intended to be used as an aid in determining the scope of the claimed subject matter.

SUMMARY

A heat pump includes a compressor configured to compress a refrigerant, a first vapor-compression circuit configured to heat or cool a space and a second vapor-compression circuit configured to heat a fluid. The first vapor-compression circuit includes at least a first portion of the refrigerant and an external source heat exchanger and the second vapor-compression circuit includes at least a second portion of the refrigerant and the external source heat exchanger. The external source heat exchanger includes three pathways. The first pathway includes the first portion of refrigerant from the first vapor-compression circuit. The second pathway includes the second portion of refrigerant from the second vapor-compression circuit. The third pathway including an external source fluid.

A method includes compressing a refrigerant in a compressor such that the refrigerant is in a high pressure gaseous state and dividing the refrigerant into the first portion using a first solenoid valve and the second portion using a second solenoid valve. Simultaneously, the first portion of the refrigerant in the first vapor-compression circuit is used to heat or cool the interior space and the second portion of the refrigerant in a second vapor-compression circuit is used to heat a fluid. Both the first portion of the refrigerant in the first vapor-compression circuit and the second portion of the refrigerant in the second vapor compression circuit exchanges heat with an external source fluid passing through the single external source heat exchanger. The first portion of refrigerant recombines with the second portion of the refrigerant before returning the refrigerant to the compressor.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION OF DRAWINGS

DETAILED DESCRIPTION

Figure 1:
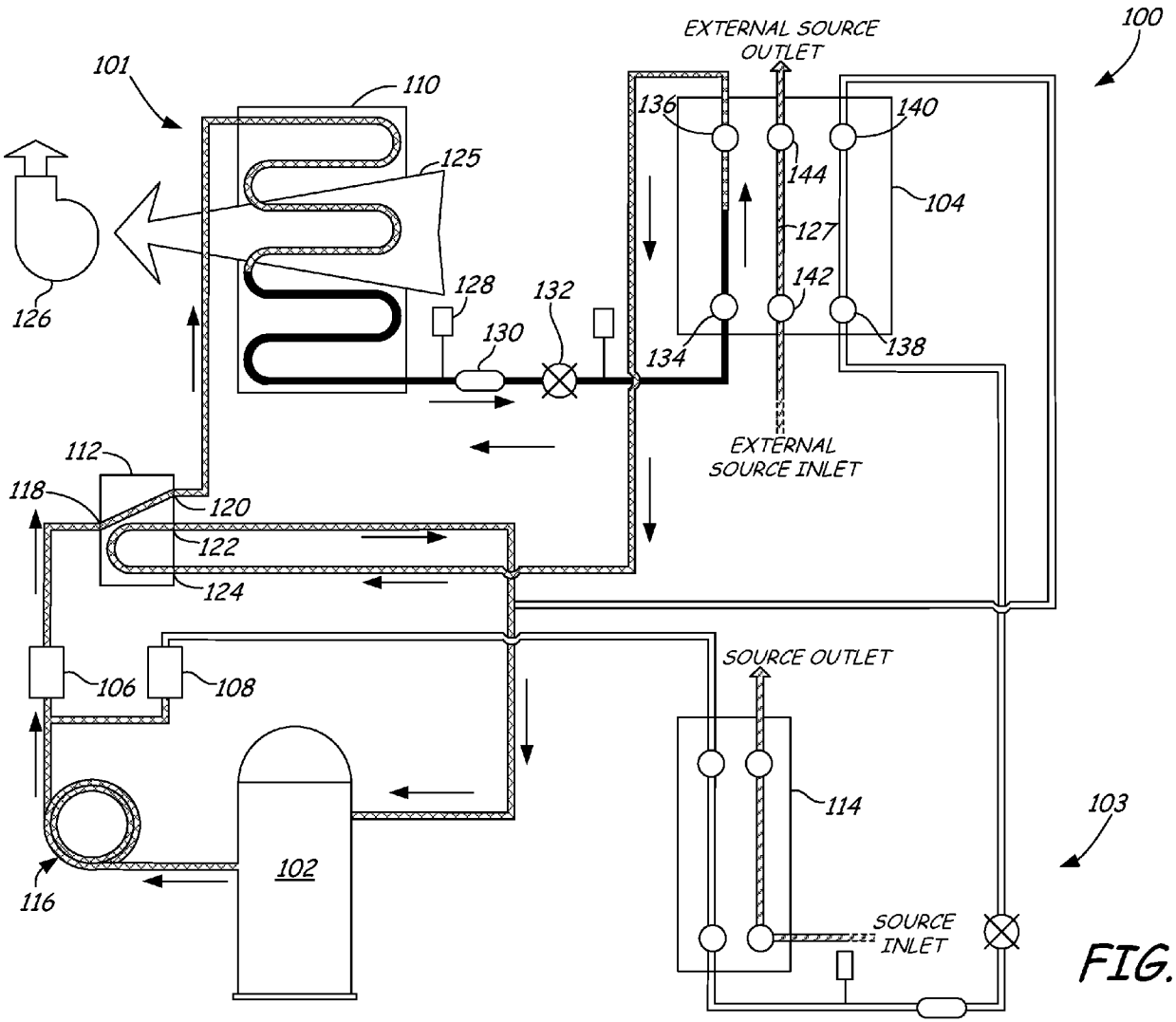
FIG. 1 illustrates a schematic diagram of a heat pump operating in accordance with one embodiment.

Embodiments of the disclosure pertain to a dual-circuit heat pump that can operate in at least five different modes. A first vapor-compression circuit or cycle provides either heating or cooling to a first environment or space, while a second vapor-compression circuit or cycle optionally provides heat to a fluid (i.e., hydronic heat). The heated fluid can be used to heat a second environment or space. In operation, a compressed intermediate fluid, such as a compressed refrigerant, is divided into two paths: the first vapor-compression circuit or cycle and the second vapor-compression circuit or cycle. The first vapor-compression circuit operates to heat or cool the first environment, while the second vapor-compression circuit simultaneously operates to heat the fluid. While refrigerant is compressed in a single compressor, each of the first and second vapor-compression circuits includes its own refrigerant-to-fluid heat exchanger, its own expansion valve and separately enters into a single external source heat exchanger before recombining and returning to the single compressor.

FIGS. 1-5 illustrate schematic diagrams of a dual-circuit heat pump 100 operating in accordance with various embodiments. Heat pump 100 includes a compressor 102, an external source heat exchanger 104, a first solenoid valve 106 and a second solenoid valve 108. Compressor 102 is configured to pressurize refrigerant. External source heat exchanger 104 is a refrigerant-to-fluid heat exchanger that transfers heat between a refrigerant and an external source fluid 127. Exemplary external sources 127 can be gases or liquids derived from external temperature reservoirs including reservoirs of outdoor air, reservoirs of outdoor water, reservoirs in the earth (i.e., geothermal), solar reservoirs or waste energy reservoirs. First solenoid valve 106 defines the beginning of first vapor-compression cycle or circuit 101 and second solenoid valve 108 defines the beginning of second vapor-compression cycle or circuit 103.

The first vapor-compression circuit 101 is configured to provide either heating or cooling via refrigerant-to-fluid heat exchanger 110 to a first environment, such as an interior space of a building. For example, and as illustrated in FIGS. 1-5, first vapor-compression circuit 101 is configured to provide either forced-air heating or cooling as evidenced by heat exchanger 110 being an air coil heat exchanger and by a reversing valve 112, which controls whether or not first vapor-compression circuit 101 is heating or cooling the first environment. However, it should be realized that other types of heat exchangers could be used and the described embodiments of first vapor-compression circuit 101 should not be limited to heating or cooling by forced air.

The second vapor-compression circuit 103 is configured to provide heat via a refrigerant-to-fluid heat exchanger 114, such as an in-floor hot water heating system, to a domestic hot water tank or a swimming pool. For example, and as illustrated in FIGS. 1-5, second vapor-compression circuit 103 is configured to provide hydronic heating as evidenced by heat exchanger 114 being a hydronic heat exchanger. However, it should be realized that other types of heat exchangers could be used and the described embodiments of second vapor-compression circuit 103 should not be limited to hydronic heating.

In FIG. 1, dual-circuit heat pump 100 is operating only first vapor-compression circuit 101 and in a heating mode. Therefore, first solenoid valve 106 is in its normally open configuration, while second solenoid valve 108 is in a closed configuration. Compressed refrigerant leaves compressor 102 in a hot, gaseous state (illustrated as cross hatch in the exemplary piping in FIG. 1) and enters into a desuperheater 116. Desuperheater 116 is a small, auxiliary heat exchanger that uses excess compressed refrigerant or superheated refrigerant gas from compressor 102 to heat water, such as water in a domestic hot water tank. After exiting desuperheater 116, hot, compressed refrigerant is allowed through normally opened first solenoid valve 106, but is blocked from flowing through closed second solenoid valve 108.

After exiting first solenoid valve 106, the compressed refrigerant enters into four-way reversing valve 112. Reversing valve 112 includes four ports. One of the ports (a first port 118) remains an inlet port regardless of the configuration of the reversing valve, while the other three ports (second, third and fourth ports 120, 122 and 124) interchangeably become one input port and two outlet ports. As illustrated in FIG. 1, reversing valve 112 is configured such that second port 120 is an outlet port, third port 122 is an outlet port and fourth port 124 is an inlet port. Therefore, in the configuration illustrated in FIG. 1, hot, compressed refrigerant enters reversing valve 112 at first port 118, exits reversing valve 112 at second port 120 and is directed to refrigerant-to-fluid heat exchanger 110, which, in the configuration illustrated in FIG. 1, acts as a condenser.

Heat exchanger 110 dissipates the heat from the compressed refrigerant to fluid (e.g., air) 125 that fan 126 pulls across the coils. In other words, the hot, high pressure refrigerant vapor is cooled in heat exchanger 110 until it condenses into a high pressure, moderate temperature liquid. After the exchange of heat, the refrigerant exits heat exchanger 110 in a high pressure liquid state (illustrated as solid fill in the exemplary piping in FIG. 1). Since reversible vapor-compression circuits use different quantities of refrigerant in either of the heating or cool modes, at the outlet of heat exchanger 110, a liquid receiver 128 temporarily stores excess refrigerant charge occurring due to the refrigerant's change of state. Receiver 128 prevents liquid back up in heat exchanger 110 that would otherwise impair system performance. The first vapor-compression circuit 101 also includes a filter/drier 130 (i.e., a component that provides both desiccant and filtration) located before a first metering device 132. Filter/drier 130 protects the system from pollution, such as dirt and foreign matter from entering the circuit or cycle lines.

The high pressure, liquid state of refrigerant enters first metering device 132. First metering device 132 is a pressure-lowering device that can be an expansion valve, capillary tube or other work extracting device. The low pressure, liquid state of the refrigerant then enters external source heat exchanger 104, which, in the configuration illustrated in FIG. 1, acts as an evaporator in first vapor-compression circuit 101

External source heat exchanger 104, such as a ground loop, includes a first refrigerant port 134, a second refrigerant port 136, a third refrigerant port 138, a fourth refrigerant port 140, a source inlet port 142 and a source outlet port 144. The low pressure, liquid refrigerant that exited first metering device 132 enters external source heat exchanger 104 at first refrigerant port 134. In external source heat exchanger 104, the low pressure, liquid refrigerant absorbs heat from the external source fluid, which is entering the external source heat exchanger at inlet port 142 and exiting the external source heat exchanger at outlet port 144, and boils. Therefore, the refrigerant exits external source heat exchanger 104 at second refrigerant port 136 as a low pressure vapor (illustrated in cross hatch in the exemplary piping) and returns to compressor 102 via reversing valve 112. As illustrated, low pressure refrigerant vapor enters reversing valve 112 at fourth port 124 and exits reversing valve 112 at third port 122.

Figure 2:
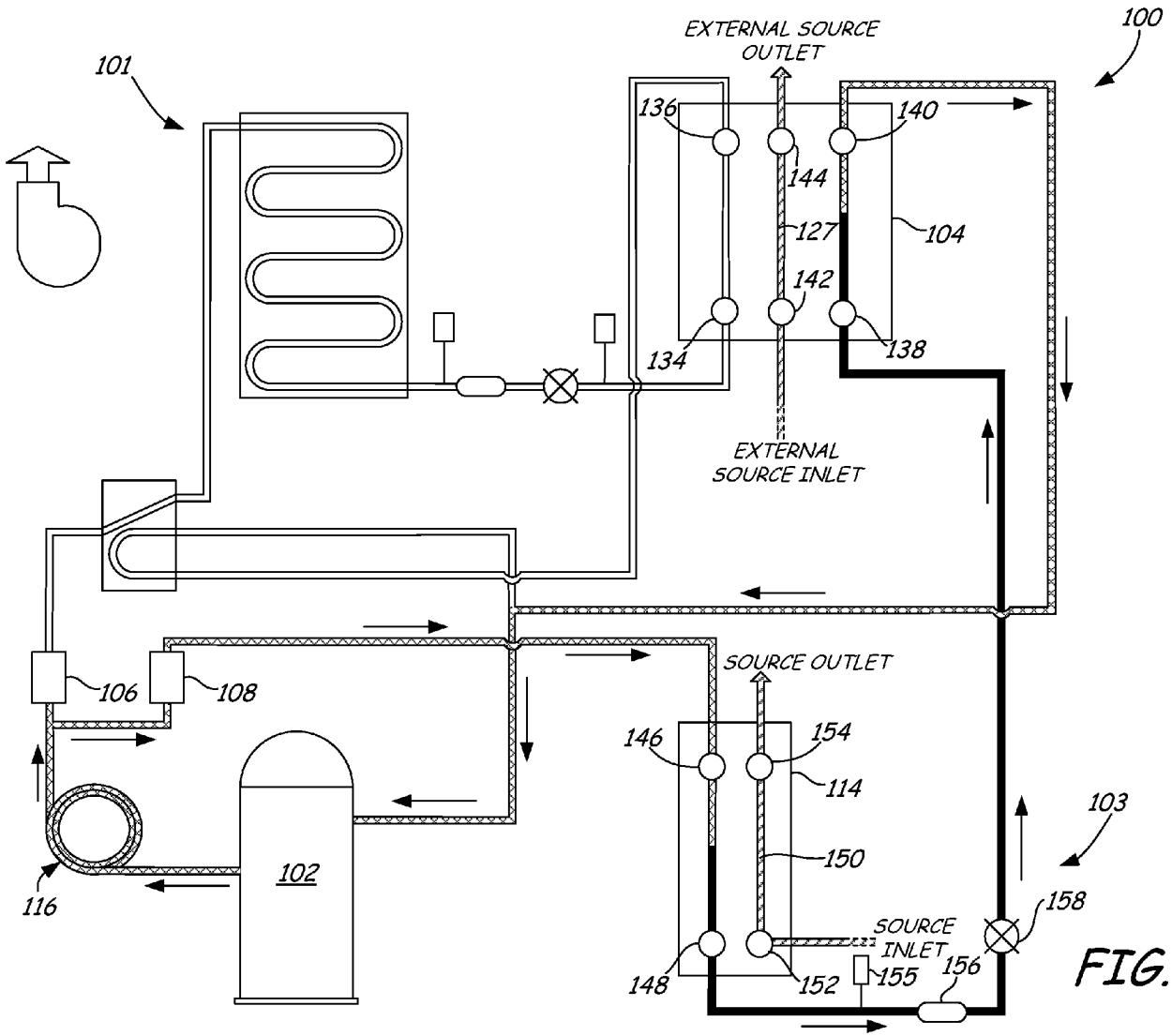
FIG. 2 illustrates a schematic diagram the heat pump illustrated in FIG. 1 operating in accordance with a second embodiment.

FIG. 2 illustrates dual-circuit heat pump 100 operating only second vapor-compression circuit 103. Therefore, first solenoid valve 106 is closed, while second solenoid valve 108 is in its normally opened configuration. Compressed refrigerant leaves compressor 102 in a hot, gaseous state (illustrated as cross hatch in the exemplary piping) and enters into desuperheater 116. As previously discussed, desuperheater 116 uses excess compressed refrigerant or superheated refrigerant gas from compressor 102 to heat water, such as water in a domestic hot water tank. After exiting desuperheater 116, hot, compressed refrigerant passes through normally opened second solenoid valve 108, but is blocked from flowing through closed first solenoid valve 106.

After exiting second solenoid valve 108, hot, compressed refrigerant vapor is directed to refrigerant-to-fluid heat exchanger 114, which, in the configuration illustrated in FIG. 2, acts as a condenser for second vapor-compression circuit 103. Heat exchanger 114 includes a refrigerant inlet port 146 and a refrigerant outlet port 148. After entering heat exchanger 114 through inlet port 146, the high pressure, hot refrigerant vapor is dissipated to the source fluid (e.g., water) 150 that enters heat exchanger 114 through a source inlet port 152 and exits heat exchanger 114 through a source outlet port 154. In other words, the hot, high pressure refrigerant vapor is cooled in heat exchanger 114 until it condenses into a high pressure, moderate temperature liquid. After the exchange of heat, the high pressure refrigerant liquid (illustrated as solid fill in the exemplary piping) exits heat exchanger 114.

Since reversible vapor-compression circuits use different quantities of refrigerant in either of the heating or cool modes, at the outlet of heat exchanger 114, a liquid receiver 155 temporarily stores excess refrigerant charge occurring due to the refrigerant's change of state. Receiver 155 prevents liquid back up in heat exchanger 114 that would otherwise impair system performance. Second vapor-compression circuit 103 also includes a filter/drier 156 (i.e., a component that provides both desiccant and filtration) located before a second metering device 158. Filter/drier 156 protects the system from pollution, such as dirt and foreign matter from entering the cycle lines.

The high pressure refrigerant liquid in the second vapor-compression circuit 103 enters second metering device 158. As with first metering device 132, second metering device 158 is a pressure-lowering device that can be an expansion valve, capillary tube or other work extracting device. The low pressure, liquid state of the refrigerant then enters external source heat exchanger 104 at third refrigerant port 138, which, in the configuration illustrated in FIG. 2, acts as an evaporator for second vapor-compression circuit 103.

In external source heat exchanger 104, the low pressure refrigerant liquid absorbs heat from the external source fluid 127, which is entering external source heat exchanger at inlet port 142 and exiting external source heat exchanger at outlet port 144, and boils. Therefore, the refrigerant exits external source heat exchanger 104 at fourth refrigerant port 140 as a low pressure vapor and returns to compressor 102.

Figure 3:
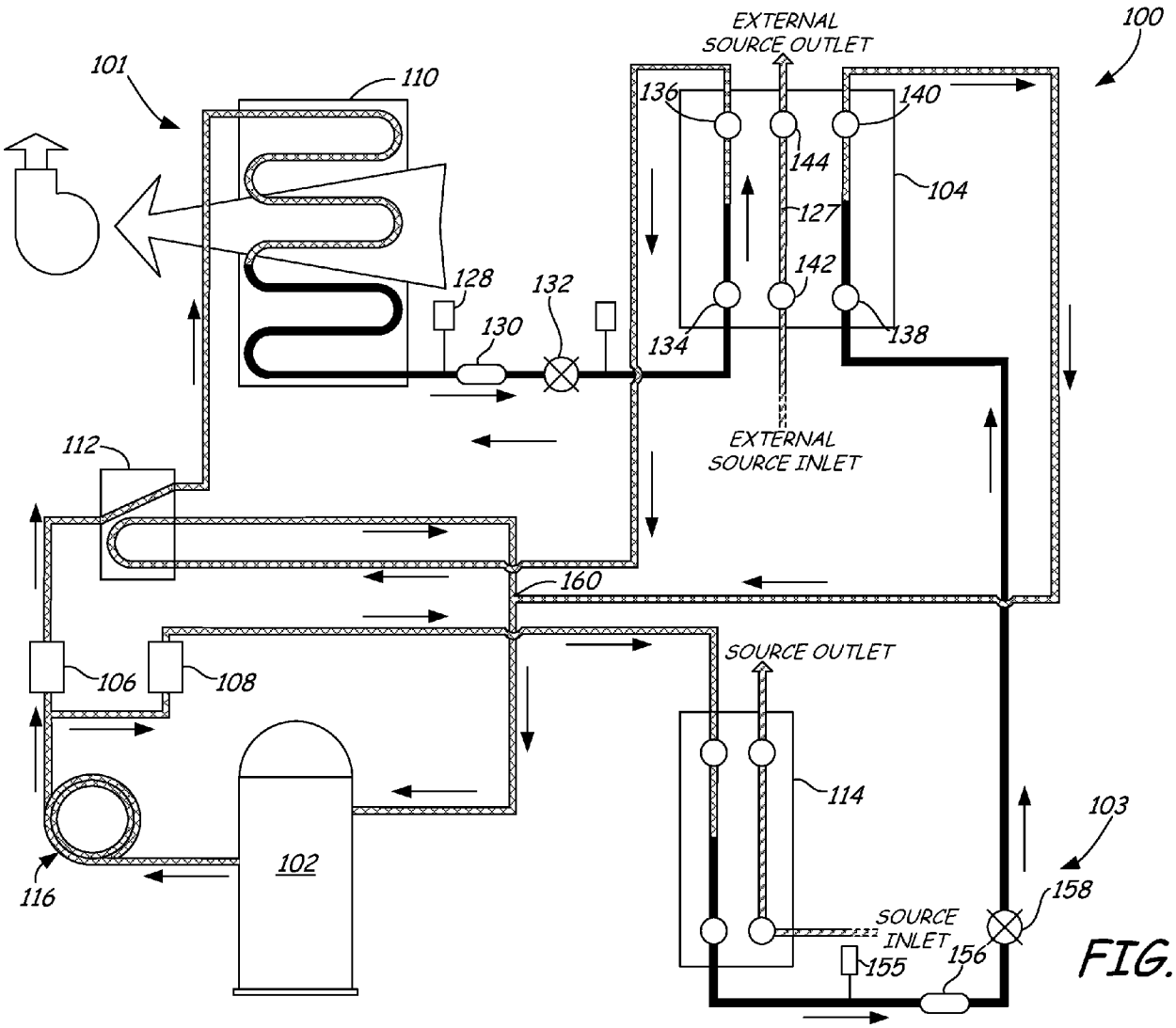
FIG. 3 illustrates a schematic diagram the heat pump illustrated in FIG. 1 operating in accordance with a third embodiment.

FIG. 3 illustrates dual-circuit pump 100 operating both the first vapor-compression circuit 101 in a heating mode and the second vapor compression circuit 103 simultaneously. Therefore, both first solenoid valve 106 and second solenoid valve 108 are in their normally open configurations. Compressed refrigerant leaves compressor 102 in a hot, gaseous state (illustrated as cross hatch in the exemplary piping) and enters into desuperheater 116. As previously discussed, desuperheater 116 uses excess compressed refrigerant or superheated refrigerant gas from compressor 102 to heat water, such as water in a domestic hot water tank. After exiting desuperheater 116, hot, compressed refrigerant vapor divides into a first portion and a second portion. The first portion passes through normally opened first solenoid valve 106 and the second portion passes through normally opened second solenoid valve 108.

After exiting first solenoid valve 106, the first portion of the refrigerant enters into four-way reversing valve 112 as described above in FIG. 1 and is directed to heat exchanger 110, which, in the configuration illustrated in FIG. 3, acts as a condenser for first vapor-compression circuit 101.

As also described above in FIG. 1, the first portion of hot, high pressure refrigerant vapor is cooled in heat exchanger 110 until it condenses into a high pressure, moderate temperature liquid. After the exchange of heat, the refrigerant exits heat exchanger 110 as a high pressure liquid (illustrated as solid fill in the exemplary piping in FIG. 3) and as previously discussed is partially stored in a liquid receiver 128 and also passes through filter/drier 130 and first metering device 132, which lowers the pressure of the liquid refrigerant. The low pressure, liquid refrigerant then enters through first refrigerant port 134 of external source heat exchanger 104, which, in the configuration illustrated in FIG. 3, acts as an evaporator for first vapor-compression circuit 101.

After exiting second solenoid valve 108, a second portion of the compressed refrigerant is directed to heat exchanger 114, which, in the configuration illustrated in FIG. 3, acts as a condenser for second vapor-compression circuit 103.

As described above in FIG. 2, the second portion of the hot, high pressure refrigerant vapor is cooled in heat exchanger 114 until it condenses into a high pressure, moderate temperature liquid. After the exchange of heat, the refrigerant exits heat exchanger 114 as a high pressure liquid (illustrated as solid fill in the exemplary piping) and passes through receiver 155, filter/drier 156 and second metering device 158. The low pressure, liquid refrigerant then enters through third refrigerant port 138 of external source heat exchanger 104, which, in the configuration illustrated in FIG. 3, acts as an evaporator for second vapor-compression circuit 103.

As illustrated in FIG. 3, first vapor-compression circuit 101 and second vapor-compression circuit 103 both utilize external source heat exchanger 104. More specifically, external source heat exchanger 104 includes three pathways and six ports 134, 136, 138, 140, 142 and 144. A first pathway includes two ports 142 and 144 (inlet and outlet ports) for defining the pathway of external source fluid 127, which in this embodiment is a fluid derived from a geothermal heat reservoir. The other four ports include first refrigerant port 134 acting as an inlet port for a second pathway of the first vapor-compression circuit 101, second refrigerant port 136 acting as an outlet port for the second pathway of first vapor-compression circuit 101, a third refrigerant port 138 acting as an inlet port for the third pathway of second vapor-compression circuit 103 and a fourth refrigerant port 140 acting as an outlet for the third pathway of second vapor-compression circuit 103. Therefore, the external source fluid 127 entering external source heat exchanger 104 through inlet port 142 exchanges heat with two refrigerant streams, each of which were originally compressed by the same compressor 102, but underwent temperature and pressure changes in different condensers and in different metering devices.

In external source heat exchanger 104, the low pressure, liquid refrigerant in first vapor-compression circuit 101 absorbs heat from the external source fluid 127 and boils. In addition, the low pressure, liquid refrigerant in second vapor-compression circuit 103 absorbs heat from the same external source fluid 127 and boils. Therefore, both the first portion of refrigerant of the first vapor-compression circuit 101 (via reversing valve 112) and the second portion of refrigerant of the second vapor-compression circuit 103 exit external source heat exchanger 104 as low pressure vapor (illustrated as cross hatch in the exemplary piping) and recombine at intersection point 160 to return to compressor 102.

Figure 4:
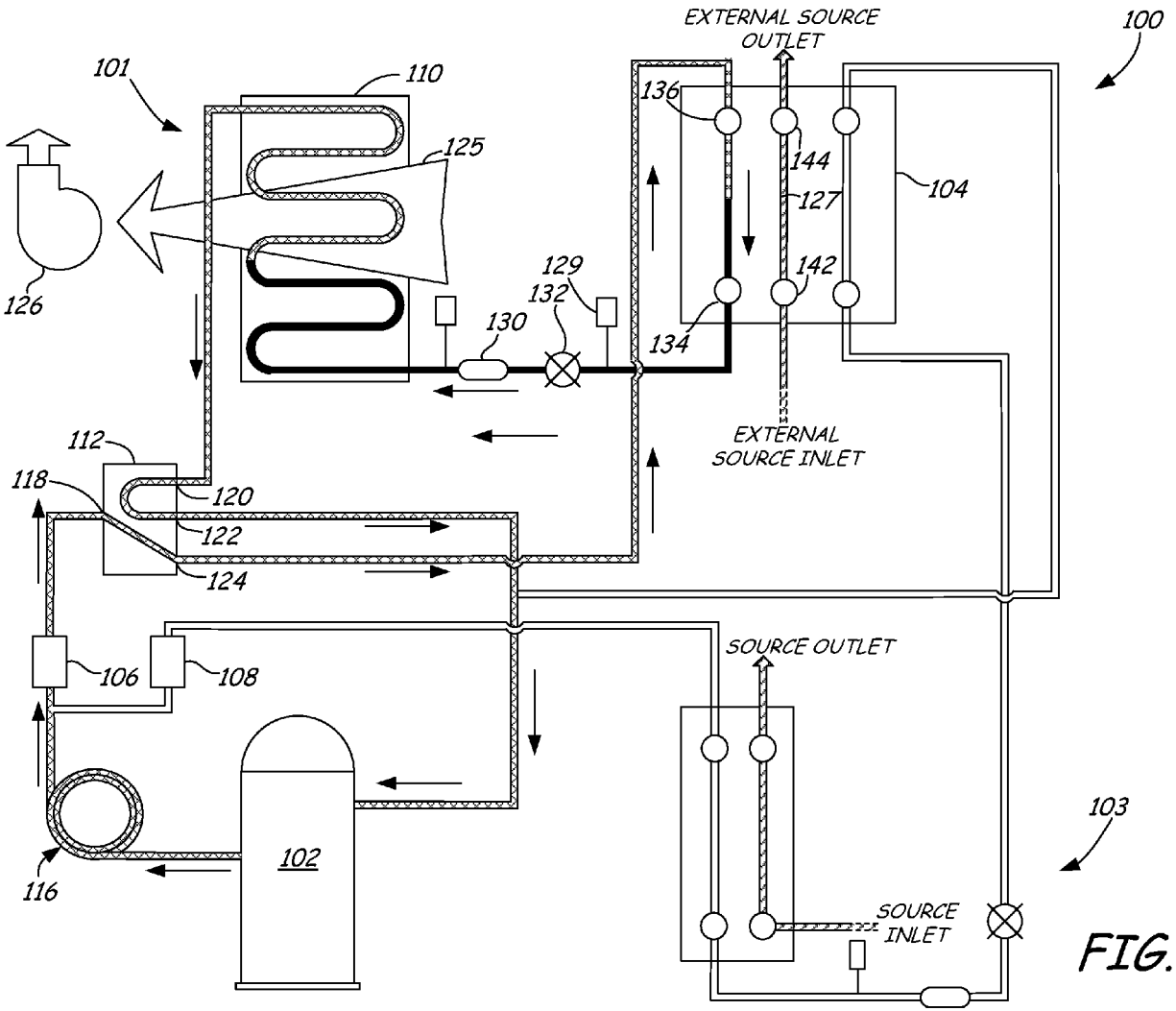
FIG. 4 illustrates a schematic diagram the heat pump illustrated in FIG. 1 operating in accordance with a fourth embodiment.

FIG. 4 illustrates dual-circuit heat pump 100 operating only the first vapor-compression circuit 101 in a cooling mode. Therefore, first solenoid valve 106 is in its normally open configuration, while second solenoid valve 108 is in a closed configuration. Compressed refrigerant leaves compressor 102 in a hot, gaseous state (illustrated as cross hatch in the exemplary piping in FIG. 4) and enters into a desuperheater 116. As previously discussed, desuperheater 116 uses excess compressed refrigerant or superheated refrigerant gas from compressor 102 to heat water, such as water in a domestic hot water tank. After exiting desuperheater 116, hot, compressed refrigerant passes through normally opened first solenoid valve 106, but is blocked from flowing through closed second solenoid valve 108.

After exiting first solenoid valve 106, the compressed refrigerant enters into four-way reversing valve 112. As previously discussed, first port 118 is an inlet port, while, as illustrated in FIG. 4, fourth port 124 is an outlet port, third port 122 is an inlet port and second port 120 is an outlet port. Therefore, in the configuration illustrated in FIG. 4, hot, compressed refrigerant enters reversing valve 112 at first port 118, exits reversing valve 112 at fourth port 124 and is directed to external source heat exchanger 104, which, in the configuration illustrated in FIG. 4, acts as a condenser for first vapor-compression circuit 101.

The hot, compressed refrigerant enters external source heat exchanger 104, such as a ground loop, at second refrigerant port 136. External source heat exchanger 104 dissipates the heat from the compressed refrigerant to the external source fluid 127 that enters through an external source inlet 142 and exits at an external source outlet 144. In other words, the hot, high pressure refrigerant vapor is cooled in external source heat exchanger 104 until it condenses into a high pressure, moderate temperature liquid, which exits at first refrigerant port 134. After the exchange of heat, the refrigerant exits external source heat exchanger 104 as a high pressure liquid (illustrated as solid fill in the exemplary piping in FIG. 4).

Since reversible vapor-compression circuits use different amounts of refrigerant quantities in the heating or cool modes, at the outlet of external source heat exchanger 104, a liquid receiver 129 temporarily stores excess refrigerant charge occurring due to the refrigerant's change of state. Receiver 129 prevents liquid from backing up into external source heat exchanger 104 that would otherwise impair system performance. As previously discussed, the first vapor-compression circuit 101 also includes filter/drier 130 located after first metering device 132. Filter/drier 130 protects the system from pollution, such as dirt and foreign matter from entering the circuit or cycle lines.

In FIG. 4, the high pressure, liquid refrigerant in the first vapor-compression circuit enters first metering device 132. First metering device 132 is a pressure-lowering device that can be an expansion valve, capillary tube or other work extracting device. The low pressure, liquid state of the refrigerant then air coil heat exchanger 110, which, in the configuration illustrated in FIG. 4, acts as an evaporator for first vapor-compression circuit 101.

The low pressure, liquid refrigerant that exited first metering device 132 enters air coil heat exchanger 110, absorbs heat from the fluid (e.g., air) 125 that is being pulled across the coils by fan 126 and boils. Therefore, the refrigerant exits heat exchanger 110 as a low pressure vapor and returns to compressor 102 via reversing valve 112. As illustrated, low pressure refrigerant vapor enters reversing valve 112 at second port 120 and exits reversing valve 112 at third port 122.

Figure 5:
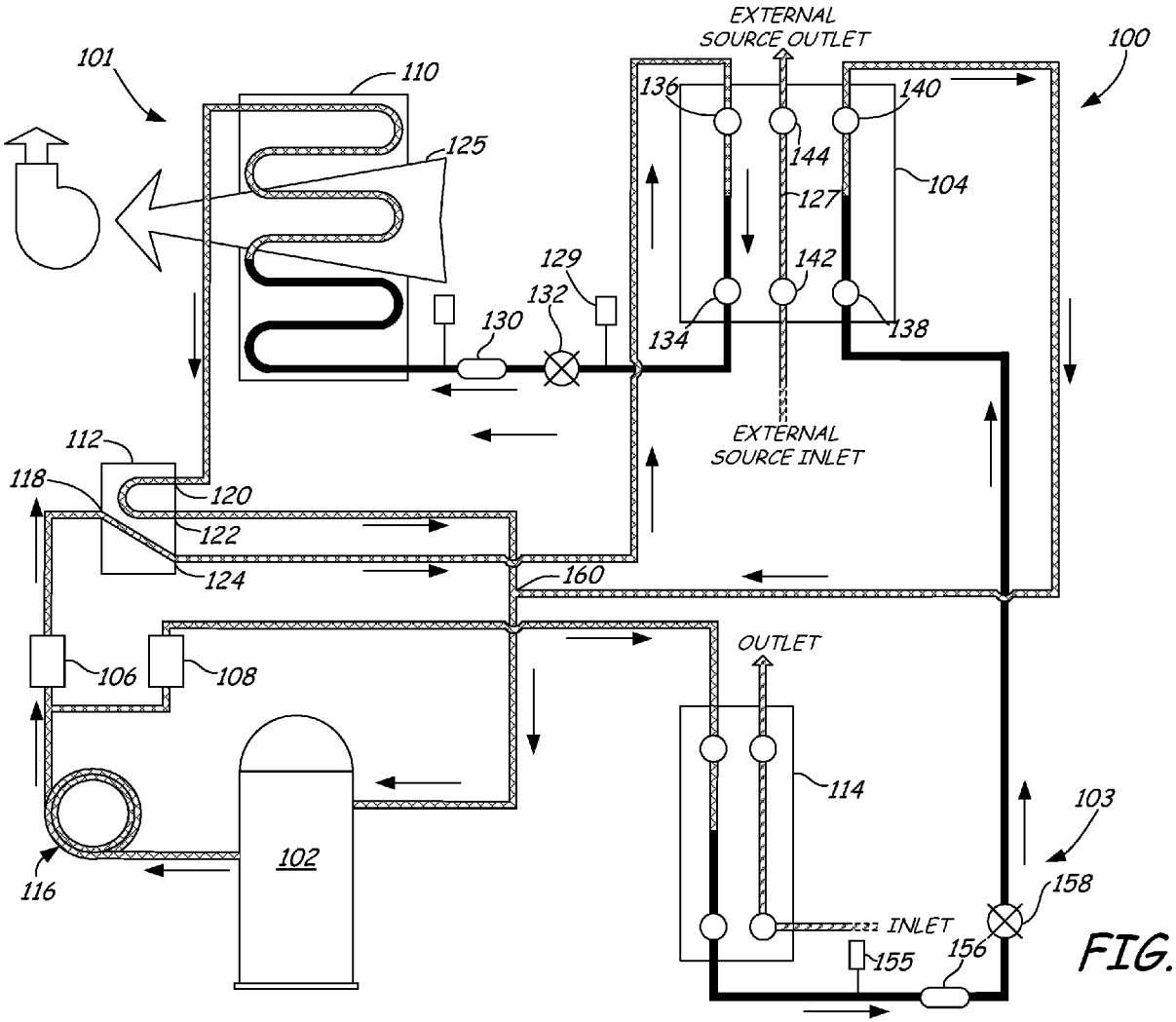
FIG. 5 illustrates a schematic diagram the heat pump illustrated in FIG. 1 operating in accordance with a fifth embodiment.

FIG. 5 illustrates dual-circuit pump 100 operating both the first vapor-compression circuit 101 in a cooling mode and the second vapor compression circuit 103 simultaneously. Therefore, both first solenoid valve 106 and second solenoid valve 108 are in their normally open configurations. Compressed refrigerant leaves compressor 102 in a hot, gaseous state (illustrated as cross hatch in the exemplary piping) and enters into desuperheater 116. As previously discussed, desuperheater 116 uses excess compressed refrigerant or superheated refrigerant gas from compressor 102 to heat water, such as water in a domestic hot water tank. After exiting desuperheater 116, hot, compressed refrigerant vapor divides into a first portion and a second portion. The first portion passes through normally opened first solenoid valve 106 and the second portion passes through second solenoid valve 108. First solenoid valve 106 valve defines the beginning of first vapor-compression circuit 101 and second solenoid valve 108 defines the beginning of second vapor-compression circuit 103.

After exiting first solenoid valve 106, the first portion of the hot, compressed refrigerant vapor in first vapor-compression circuit 101 enters into four-way reversing valve 112 as described above in FIG. 4 and is directed to external source heat exchanger 104, which, in the configuration illustrated in FIG. 5, acts as a condenser for first vapor-compression circuit 101.

After exiting second solenoid valve 108, the second portion of the hot, compressed refrigerant vapor in second vapor-compression circuit 103 is directed to heat exchanger 114, which, in the configuration illustrated in FIG. 5, acts as a condenser for the second vapor-compression circuit 103. As described above in FIG. 2, the second portion of the high pressure refrigerant vapor is cooled in heat exchanger 114 until it condenses into a high pressure, moderate temperature liquid. After the exchange of heat, the refrigerant exits heat exchanger 114 in a high pressure liquid state (illustrated as solid fill in the exemplary piping) and passes through receiver 155, filter/drier 156 and second metering device 158, which lowers the pressure of the liquid refrigerant.

As illustrated in FIG. 5, first vapor-compression circuit 101 and second vapor-compression circuit 103 both utilize external source heat exchanger 104. In the cooling mode, the first vapor-compression circuit 101 utilizes external source heat exchanger 104 as a condenser and the second vapor-compression circuit utilizes external source heat exchanger 104 as an evaporator. More specifically, external source heat exchanger 104 includes three pathways and six ports 134, 136, 138, 140, 142 and 144. The first pathway includes ports 142 and 144 (inlet and outlet ports) for receiving and expelling external source fluid 127, which in this embodiment is derived from a geothermal heat reservoir. The other four ports include first refrigerant port 134 acting as an outlet for the second pathway of first vapor-compression circuit 101, second refrigerant port 136 acting as an inlet for the second pathway of first vapor-compression circuit 101, third refrigerant port 138 acting as an inlet for the third pathway of second vapor-compression circuit 103 and fourth refrigerant port 140 acting as an outlet for the third pathway of second vapor-compression circuit 103. Therefore, external source fluid 127 enters external source heat exchanger 104 through inlet port 142 to exchange heat with two refrigerant streams, each of which were originally compressed by the same compressor 102. The first refrigerant stream utilizes the external source heat exchanger 104 as a condenser, while the second refrigerant stream utilizes the external source heat exchanger 104 as an evaporator. Each refrigerant stream underwent or will undergo pressure changes in different metering devices.

As described above in FIG. 4, the first portion of high pressure refrigerant vapor of first vapor-compression circuit 101 enters external source heat exchanger 104 through second refrigerant port 136 and is cooled in external source heat exchanger 104 using external source fluid 127 until it condenses into a high pressure, moderate temperature liquid (illustrated as solid fill in the exemplary piping in FIG. 5) and exits at first refrigerant port 134. Meanwhile, the low pressure, liquid refrigerant from heat exchanger 114 enters through third refrigerant port 138 of external source heat exchanger 104 and absorbs heat from the external source fluid 127 and boils. Therefore, the refrigerant in first vapor-compression circuit 101 exits external source heat exchanger 104 as a high pressure, moderate temperature liquid, while the refrigerant in second vapor-compression circuit 103 exits external source heat exchanger 104 as a low pressure vapor.

After the exchange of heat, the refrigerant in first vapor-compression circuit 101 exits external source heat exchanger 104, is partially stored in a liquid receiver 129, passes through first metering device 132, which lowers the pressure of the liquid refrigerant, and passes through filter/drier 130. The low pressure, liquid refrigerant then enters heat exchanger 110, which, in the configuration illustrated in FIG. 5, acts as an evaporator for the first vapor-compression circuit. 101.

The low pressure, liquid refrigerant that exited first metering device 132 enters heat exchanger 110, absorbs heat from the fluid (i.e., air) 125 that is being pulled across the coils by fan 126 and boils. Therefore, the refrigerant exits heat exchanger 110 as a low pressure vapor. As illustrated, low pressure refrigerant vapor enters reversing valve 112 at second port 120 and exits reversing valve 112 at third port 122 to recombine at intersection point 160 with low pressure refrigerant vapor from the second vapor-compression circuit 103 to return to compressor 102.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A heat pump comprising:

a compressor configured to compress a refrigerant;

a first vapor-compression circuit configured to heat or cool a space, the first vapor-compression circuit including at least a first portion of the refrigerant and an external source heat exchanger; and a second vapor-compression circuit configured to heat a fluid, the second vapor-compression circuit including at least a second portion of the refrigerant that is different from the first portion of refrigerant and the external source heat exchanger;

wherein the external source heat exchanger includes three pathways, the first pathway including the first portion of refrigerant from the first vapor-compression circuit, the second pathway including the second portion of refrigerant from the second vapor-compression circuit and the third pathway including an external source fluid.

2. The heat pump of claim 1, further comprising a desuperheater that receives the compressed refrigerant from the compressor and utilizes excess compressed refrigerant to heat water.

3. The heat pump of claim 1, wherein the first vapor-compression circuit further comprises a refrigerant-to-fluid heat exchanger for providing heating or cooling to an interior space.

4. The heat pump of claim 3, wherein the first vapor-compression circuit further comprises a four-way reversing valve located between the compressor and the refrigerant-to-fluid heat exchanger and located between the compressor and the external source heat exchanger, the four-way reversing valve having a first configuration and a second configuration.

5. The heat pump of claim 4, wherein in the first configuration of the four-way reversing valve the first portion of the refrigerant is first directed to the refrigerant-to-fluid heat exchanger to condense the first portion of refrigerant and heat the interior space and the first portion of refrigerant is then subsequently directed to the external source heat exchanger to evaporate the first portion of refrigerant before being directed back to the compressor.

6. The heat pump of claim 4, wherein in the second configuration of the four-way reversing valve the first portion of the refrigerant is first directed to the external source heat exchanger to condense the first portion of refrigerant and the first portion of refrigerant is then subsequently directed to the refrigerant-to-fluid heat exchanger to evaporate the first portion of refrigerant and cool the interior space.

7. The heat pump of claim 3, wherein the first vapor-compression circuit further comprises a metering device located between the refrigerant-to-fluid heat exchanger and the external source heat exchanger to lower the pressure of the first portion of refrigerant before the first portion of refrigerant is evaporated.

8. The heat pump of claim 1, wherein the second vapor-compression circuit further comprises a refrigerant-to-fluid heat exchanger, the second portion of refrigerant is first directed to the refrigerant-to-fluid heat exchanger to condense the second portion of refrigerant and heat an external water source and the second portion of the refrigerant is then subsequently directed to the external source heat exchanger to evaporate the second portion of refrigerant before being directed back to the compressor.

9. The heat pump of claim 8, wherein the second vapor-compression circuit further comprises a metering device located between the refrigerant-to-fluid heat exchanger and the external source heat exchanger to lower the pressure of the second portion of refrigerant before the second portion of refrigerant is evaporated.

10. A heat pump comprising:

a compressor configured to compress a refrigerant;

a first vapor-compression cycle configured to heat or cool a space, the first vapor compression cycle comprising:

a first refrigerant-to-fluid heat exchanger configured to condense a first portion of the refrigerant in a heating mode and configured to evaporate the first portion of the refrigerant in a cooling mode;

a second refrigerant-to-fluid heat exchanger configured to evaporate the first portion of the refrigerant in the heating mode and configured to condense the first portion of the refrigerant in the cooling mode;

a first metering device located between the first refrigerant-to-fluid heat exchanger and the second refrigerant-to-fluid heat exchanger;

a second vapor compression cycle configured to heat a fluid, the second vapor-compression cycle comprising:

a third refrigerant-to-fluid heat exchanger configured condense a second portion of the refrigerant;

the second refrigerant-to-fluid heat exchanger configured to evaporate the second portion of the refrigerant; and a second metering device located between the third refrigerant-to-fluid heat exchanger and the second refrigerant-to-fluid heat exchanger;

wherein the first portion of refrigerant and the second portion of refrigerant recombine before returning to the compressor.

11. The heat pump of claim 10, further comprising a desuperheater that receives the compressed refrigerant from the compressor and utilizes excess compressed refrigerant to heat water.

12. The heat pump of claim 10, wherein the second refrigerant-to-fluid heat exchanger comprises six ports, the six ports including first and second refrigerant ports interchangeable between inlet and outlet ports for the first vapor compression cycle, third and fourth refrigerant ports acting as inlet and outlet ports for the second vapor compression cycle and fifth and sixth external source ports acting as inlet and outlet ports for an external fluid source.

13. The heat pump of claim 10, wherein the first vapor compression cycle further comprises at least one liquid receiver located between the first refrigerant-to-fluid heat exchanger and the second refrigerant-to-fluid heat exchanger for temporarily storing excess of the first portion refrigerant that occurs when the first portion of refrigerant changes state.

14. The heat pump of claim 10, wherein the first vapor compression cycle further comprises a filtration/desiccant component located between the first refrigerant-to-fluid heat exchanger and the second refrigerant-to-fluid heat exchanger for preventing dirt and foreign matter from entering the first vapor compression cycle.

15. The heat pump of claim 10, wherein the second vapor compression cycle further comprises at least one liquid receiver located between the third refrigerant-to-fluid heat exchanger and the second refrigerant-to-fluid heat exchanger for temporarily storing excess of the second portion refrigerant that occurs when the second portion of refrigerant changes state.

16. The heat pump of claim 10, wherein the second vapor compression cycle further comprises a filtration/desiccant component located between the third refrigerant-to-fluid heat exchanger and the second refrigerant-to-fluid heat exchanger for preventing dirt and foreign matter from entering the second vapor compression cycle.

17. A method comprising:

compressing a refrigerant in a compressor such that the refrigerant is in a high pressure gaseous state;

dividing the refrigerant into a first portion using a first solenoid valve and a second portion using a second solenoid valve;

simultaneously using the first portion of the refrigerant in a first vapor-compression circuit to heat or cool a space and the second portion of the refrigerant in a second vapor-compression circuit to heat a fluid, both the first portion of the refrigerant in the first vapor-compression circuit and the second portion of the refrigerant in the second vapor compression circuit exchanges heat with an external source fluid passing through a single external source heat exchanger; and recombining the first portion of refrigerant with the second portion of the refrigerant before returning the refrigerant to the compressor.

18. The method of claim 17, further comprising configuring a four-way reversing valve into a first configuration to direct the first portion of refrigerant through the first vapor-compression circuit to heat the space and configure the four-way reversing valve into a second configuration to direct the first portion of refrigerant through the first vapor-compression circuit to cool the space.

19. The method of claim 17, further comprising passing the first portion of refrigerant through the single external source heat exchanger using interchangeable first and second ports that define a first pathway, passing the second portion of refrigerant through the single external source heat exchanger using third and fourth ports that define a second pathway and passing the external source fluid through the single external source heat exchanger using fifth and sixth ports that define a third pathway.

* * * * *